US008206554B2

(12) United States Patent
Pihola

(10) Patent No.: US 8,206,554 B2
(45) Date of Patent: Jun. 26, 2012

(54) METHOD AND A SYSTEM FOR CONTROLLING THE MANUFACTURING OR FINISHING PROCESS OF A FIBER WEB

(75) Inventor: Pekka Pihola, Vantaa (FI)

(73) Assignee: Metso Paper, Inc., Helsinki (FI)

( * ) Notice: Subject to any disclaimer, the term of this patent is extended or adjusted under 35 U.S.C. 154(b) by 443 days.

(21) Appl. No.: 12/516,518

(22) PCT Filed: Nov. 28, 2007

(86) PCT No.: PCT/FI2007/050643

§ 371 (c)(1),
(2), (4) Date: May 27, 2009

(87) PCT Pub. No.: WO2008/065252

PCT Pub. Date: Jun. 5, 2008

(65) Prior Publication Data

US 2010/0043993 A1 Feb. 25, 2010

(30) Foreign Application Priority Data

Dec. 1, 2006 (FI) ..... 20065770

(51) Int. Cl.
*D21F 11/00* (2006.01)

(52) U.S. Cl. ..... 162/198; 162/262; 162/263; 162/259; 700/127; 700/128; 700/129

(58) Field of Classification Search ..... 162/198, 162/262, 263, 259; 700/127–129
See application file for complete search history.

(56) References Cited

U.S. PATENT DOCUMENTS

| | | | | |
|---|---|---|---|---|
| 4,874,467 | A | 10/1989 | Karlsson et al. | |
| 6,553,270 | B1 * | 4/2003 | Houle et al. | 700/54 |
| 2004/0045454 | A1 * | 3/2004 | Maenpaa et al. | 100/168 |
| 2006/0048910 | A1 | 3/2006 | Ferm et al. | |

FOREIGN PATENT DOCUMENTS

| | | | |
|---|---|---|---|
| FI | 115325 | B | 7/2002 |
| WO | 01/27390 | A1 | 4/2001 |
| WO | 01/75226 | A1 | 10/2001 |
| WO | 2008/065252 | A1 | 6/2008 |
| WO | 02/22949 | A1 | 3/2009 |

OTHER PUBLICATIONS

Written Opinion of the International Searching Authority issued in PCT/FI2007/050643.
Search Report issued in PCT/FI2007/050643.

* cited by examiner

*Primary Examiner* — Eric Hug
*Assistant Examiner* — Jacob Thomas Minskey
(74) *Attorney, Agent, or Firm* — Stiennon & Stiennon

(57) ABSTRACT

A method and a system for controlling the manufacturing or finishing process of a fiber web at a transition stage of the process. In the method a corrected error profile ($P_{D'k}$) is formed using an error profile ($P_D$). Using the corrected error profile ($P_{D'k}$) at least one control signal ($CA_k$) is determined for the actuators (6) of the manufacturing or finishing process of a fiber web.

19 Claims, 5 Drawing Sheets

METHOD AND A SYSTEM FOR CONTROLLING THE MANUFACTURING OR FINISHING PROCESS OF A FIBER WEB

CROSS REFERENCES TO RELATED APPLICATIONS

This application is a U.S. national stage application of International App. No. PCT/FI2007/050643, filed Nov. 28, 2007, the disclosure of which is incorporated by reference herein, and claims priority on Finnish App. No. 20065770 filed Dec. 1, 2006.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for controlling the manufacturing or finishing process of a fiber web at a transition stage of the process in which an error profile is used for determining at least one control signal for the actuators of the manufacturing or finishing process of a fiber web. The invention also relates to a system for controlling the manufacturing or finishing process of a fiber web at a transition stage of the process, which system comprises at least one actuator for affecting the process and controlling the properties of the web (W), a control unit for controlling the process, said control unit comprising control means arranged to form at least one control signal for at least one actuator and that the control means are arranged to form a new control signal by means of a new correction profile.

In the manufacturing or finishing process of a fiber web, for example in the manufacturing or finishing process of a paper or paperboard web, the properties of paper are constantly monitored by means of on-line measurements. The measurements are conducted in the cross-direction of paper in order to produce the profile of the measured property in the cross direction of the paper. Typically the measurements are performed by means of measuring apparatuses, in which a moving fiber web is measured by means of measuring sensors moving back and forth in its cross direction (CD). The properties to be measured may include for example moisture, caliper, basis weight, ash content, color, opacity, brightness, gloss, or smoothness of the web.

The results obtained from the measuring sensors are used not only for monitoring the properties of paper, but also for controlling the manufacturing and finishing devices of paper. The measurement results are transmitted to a control unit, in which they are utilized to determine control signals for profiling apparatuses belonging to the manufacturing or finishing process of paper and affecting said paper property in the cross direction of the paper web. Each of these profiling apparatuses contains one or several actuators affecting a point corresponding to their location in the cross direction of the paper web. The control profile of the profiling device typically comprises the control signals of the actuators relating thereto.

When controlling cross direction profiles, the processing of signals is typically performed by processing information in profile form. For each variable to be measured an error profile is determined, the error profile being the deviation between the profile formed on the basis of the measurement results and the target profile set for the variable, said error profile describing the error in the adjustment. The purpose of the control is to keep the process as accurately as possible in a state complying with the targets determined for the process. By means of the error profile the control unit forms control commands for one or several profiling devices or actuators that affect the process and bring about a change therein complying with the control commands. The prior art control of a manufacturing or finishing process of a fiber web as described above is shown in a very simplified manner in FIG. 1. The process 1 is controlled by a control unit 2, marked with broken lines in the figure. In the process at least one property of a moving fiber web is measured constantly in its cross direction by means of at least one measuring device 3. The measuring devices may be composed of one or several measuring sensors, which are moved back and forth in the cross direction of the web, across the width of the web. As a measuring device it is also possible to use one or several stationary measuring devices positioned in the cross direction of the web in such a manner that their measuring area covers substantially the entire width of the web. The measurement results M produced by the measuring devices are transmitted to a control unit 2, which contains means for processing the measurement results M and forming the control signals. The control unit comprises comparison means 4 to which the measurement results are input. The target values of the process property are also input in the comparison means. The comparison means compare the measured values of the process with the target values of said process property and form an error profile $P_D$ on the basis of the comparison, which profile is sent to the control means 5 of the control unit. The control means 5 contain control algorithms forming control signals C on the basis of the error profile $P_D$, which control signals are sent to one or several actuators 6 affecting said property of the web. The actuators are arranged across the width of the web so that they each have a separate area of influence in the cross direction of the web. The control signals C cause the necessary change in the operation of the actuator 6, thus affecting the manufacturing or finishing process of the fiber web as well as the properties of the web that is being manufactured. The control unit updates the error profile $P_D$ for example constantly in accordance with a given measurement cycle, time or control interval, producing the control commands C typically on the basis of the last error profile. The error profile $P_D$ can be calculated for example at intervals of two measurement scans across the width of the web. The function of the control unit and the means relating thereto are known as such by a person skilled in the art, and therefore they will not be described in more detail in this context.

One problem in the manufacturing or finishing process of a fiber web are regularly occurring disturbances in the operating stages i.e. transition stages deviating from the normal run. The disturbances are typically similar in similar situations and they produce defects in the web that is being manufactured. As a result of the defects the target quality of the web is not reached and the product produced in the process cannot be delivered to a client, but it is treated as a reject. This is not cost-effective.

The transition stages in which the above-mentioned recurrent errors occur include for example a disturbance in the process, a change in a set value relating to the process, starting up of the process or its parts or deceleration before stopping the process. For example after a break, when the process has been started again, the quality of the product does not typically correspond to the target values set for the product, but the target values are reached only after a while from starting the production. The control unit of the process, the automation systems and the actuators control the process during the entire transition stage, but it takes time to reach acceptable product quality. There have been attempts to shorten the time passed for reaching the target quality in various ways, for example by running the process manually. In the manual run the operator can correct the quality of the product by changing the position of the actuators in a way that deviates from the function of the automatic control.

Publication U.S. Pat. No. 4,874,467 discloses a method for controlling the cross-direction profiles of the properties of the paper web. In the publication the position of the actuators controlling the size of the slice of the headbox is adjusted by means of cross direction profiles measured from the paper. In the method the cross direction profile of a certain property of the paper is measured and compared to the target profile. On the basis of the comparison an error profile is formed, which is used further for determining control commands for the actuators.

Publication FI-115325 discloses a method for controlling the manufacturing process of a web, in which a cross direction profile of a certain property of the paper that is being manufactured is determined and compared with a target profile/and an error profile is formed on the basis of the comparison. In process control a group of process models is used, and each one of them is used together with the error profile to determine control operations for the actuators of the process.

Publication F1 116403 (corresponding international publication WO 02/22949) discloses a method for controlling cross direction properties of a web in a calender. In the method at least one cross-direction profile of a web property is measured and compared with the target profile and an error profile is formed. The control process also utilizes a model predicting the effect of the profiling member to a paper property changing in the calendering, said model forming by means of the error profile a control signal to the actuators affecting the measured property.

The drawback of the methods disclosed in the above-mentioned publications is the restriction relating to the feedback information utilized by them. This restriction is the delay caused by the movement time of the measuring sensors in the cross direction of the web. Thus, in transition stages of the above kind the control unit is not capable of reacting sufficiently fast.

One finishing method of a fiber web is calendering, in which the web is passed through one or more nips formed between two surfaces, typically between roll surfaces rotating against each other. The purpose of the calendering is for instance to compress the paper to increase its density, to balance the caliper variations and to improve the surface properties, for example the smoothness and gloss of the surface. Typically, one of the rolls forming a calendering nip is a hard-faced, heated thermo roll and the other roll is a soft-faced roll whose profile can be adjusted or a polymer roll. The roll whose profile can be adjusted may be for example a variable-crown calender roll containing inside itself one or several profiling members, such as loading elements affecting the shell of the roll radially in the direction of the axis of the roll. The loading elements are typically hydraulic pistons which are pressed against the shell of the roll to form the desired profile for the load, i.e. nip load transmitted via the roll to the nip and further to the paper web to be calendered. Thus, it is at the same time possible to compensate the change in the profile caused by the deflection of the roll. The number of loading elements depends on the width of the roll, and they are typically positioned at intervals of 10 to 20 cm in the direction of the axis of the roll. The loading elements can be controlled separately. The controlling takes place by controlling the oil pressure of the loading elements by means of the control system.

The beginning of the calendering and the starting up of the calender can be mentioned as an example of a transition stage in which rapidly developing disturbances occur in the cross direction caliper profiles of the fiber web. FIG. 2 shows a graph illustrating a typical CD caliper profile of a web, measured a few minutes after starting the calendering. As the graph shows, a strong deviation in the caliper profile of the web occurs on both edge areas of the calender when compared to the caliper profile formed by the central part of the calender. The variations primarily result from irregular changes occurring in the flows and distributions of thermal energy inside the calender rolls. The thermal energy flows in the rolls and the temperatures of the rolls are stabilized in an equilibrium corresponding to the running state in the course of time and the function of the control system as well as the quality of the product improve on an acceptable level. This may take for example approximately 15 minutes. It takes some time after this to reach a completely stable run. Also with calenders, attempts have been made to speed up the recovery of the process by switching off the automatic control of the process and controlling the profiling actuator manually. In manual control the linear load profile of the calendering nip is typically influenced by changing the position of hydraulic actuators in the variable-crown roll forming the calender nip so that the caliper profile in the cross-direction of the web would be as uniform as possible.

By controlling the profiling actuator manually at the transition stage, it is possible to reduce the effect of the disturbance to a certain extent. However, the manual method is always very dependent on the skills and experience of the operator. In practice, it has been discovered that by keeping the automatic control switched off during such a production stage until the direction of the error development changes, the time passed after the operating stage for the recovery of the production is shortened approximately 30%. By predicting the error after or before the operating stage it is possible to attain even better results. However, this result is completely insufficient economically.

SUMMARY OF THE INVENTION

The purpose of the present invention is to introduce such a method and system for controlling a manufacturing and finishing process of a fiber web at a transition stage of the process that avoid the aforementioned problems and enable the control of the process in such a manner that it is possible to minimize the amount of product treated as a reject.

The invention is based on the idea that empirical information, such as correction profiles are utilized for forming control signals to be transmitted to actuators at a transition stage of a manufacturing or finishing process of a fiber web, which correction profiles can be updated by means of an error profile of a web property formed in a control unit.

The correction profiles are determined in the control unit that calculates new control signals for the actuators. The determined correction profiles are stored in the memory means of the control unit so that they form correction profile series. One correction profile series comprises successive correction profiles determined during one transition stage of the process. Each one of the correction profiles in the series is connected to the progress of the transition stage, i.e. to one or several calculations of the control signal.

Control signals and correction profiles series determined in earlier corresponding transition stages and stored in memory means are utilized for producing new control signals. Error profiles determined by means of measurements attained from the process and target values of the process are also utilized.

When the transition stage begins, one of the correction profile series determined in a corresponding earlier transition stage is selected and used in the calculation. Individual correction profiles of the selected correction profile series are used for forming the control signals so that on the basis of an individual old correction profile selected from the series and the determined error profile a corrected error profile is formed, which is used for forming a control signal. The determined error profiles are also utilized for updating a correction profile used in the previous calculation and stored in the memory means. Thus, each correction profile contains empirical information for the next calculation cycle of the control signal, by means of which the control unit is capable of performing the necessary correction for compensating the effect of the disturbance beforehand in the calculation of the control signals.

The solution according to the invention for forming control signals is thus a solution based on empirical learning and on the fact that the transition stage repeats itself with similar effects. It is a learning and predictive solution and does not require modeling of the process or updating the models of an already modeled process or other maintenance tasks. The system and method according to the invention do not constitute a controller, but a separate control solution to be used in connection with a controller, which can be easily taken in use. Naturally, the system according to the invention can be integrated in a controller controlling the process. The invention can be easily implemented in control systems currently in use.

Another advantage of the invention is that as a result of the manufacturing or finishing process a maximum amount of product measuring up to the target quality is attained, because the process can be controlled better in its transition stages. Changes caused by the operator in the way of running the process are eliminated, which will reduce errors resulting from manual adjustments. Thus, the target level of the product quality is attained more rapidly.

BRIEF DESCRIPTION OF THE DRAWINGS

In the following, the invention will be described in more detail with reference to the appended drawings.

DESCRIPTION OF THE PREFERRED EMBODIMENTS

In this description and in the claims the concept of a transition stage of a process refers to a recognizable operating stage deviating from the normal run of the process. At this stage the process is running and during the process regularly occurring errors are detected in the CD profile of a certain property of the web. Such transition stages include for example starting up of the process or its parts or deceleration of the functions of the process before stopping the process. Errors can be caused for example by the structural properties of the actuators or parts of the process, for example felts or wires used in the manufacturing or finishing line of paper or paperboard. The concept of a regularly occurring error refers to an error occurring either during the entire operating stage or at regular intervals, which error can be seen in the CD profile of a web property measured from the web. Furthermore, in this description and in the claims the term "paper" also refers to paperboard. The concept of a fiber web W refers to a fiber web containing at least partly natural fiber material, such as wood fibers. It is also possible to use for example straw or bagasse as fiber material.

Figure 1:
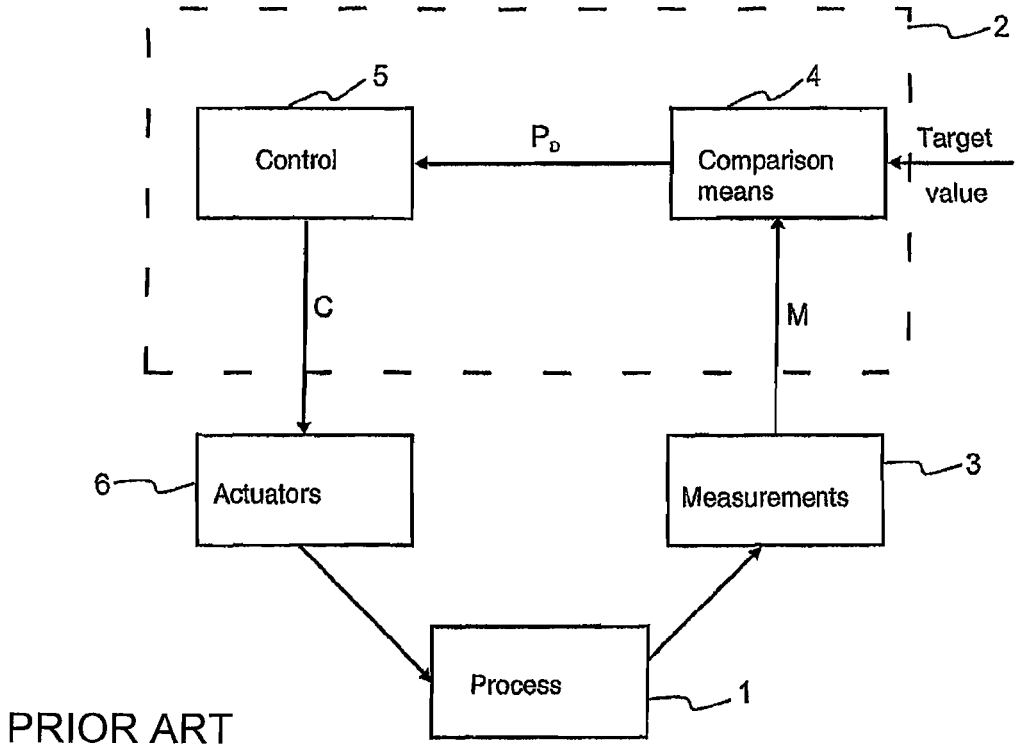
FIG. 1 is a schematic block chart illustrating prior art process control.
Figure 2:
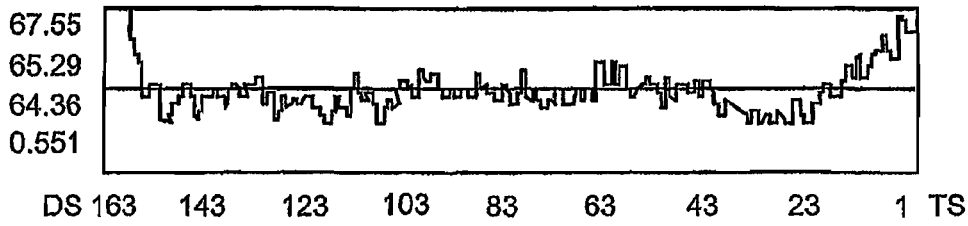
FIG. 2 shows the CD profile of the caliper of the web measured after the calender.
Figure 3:
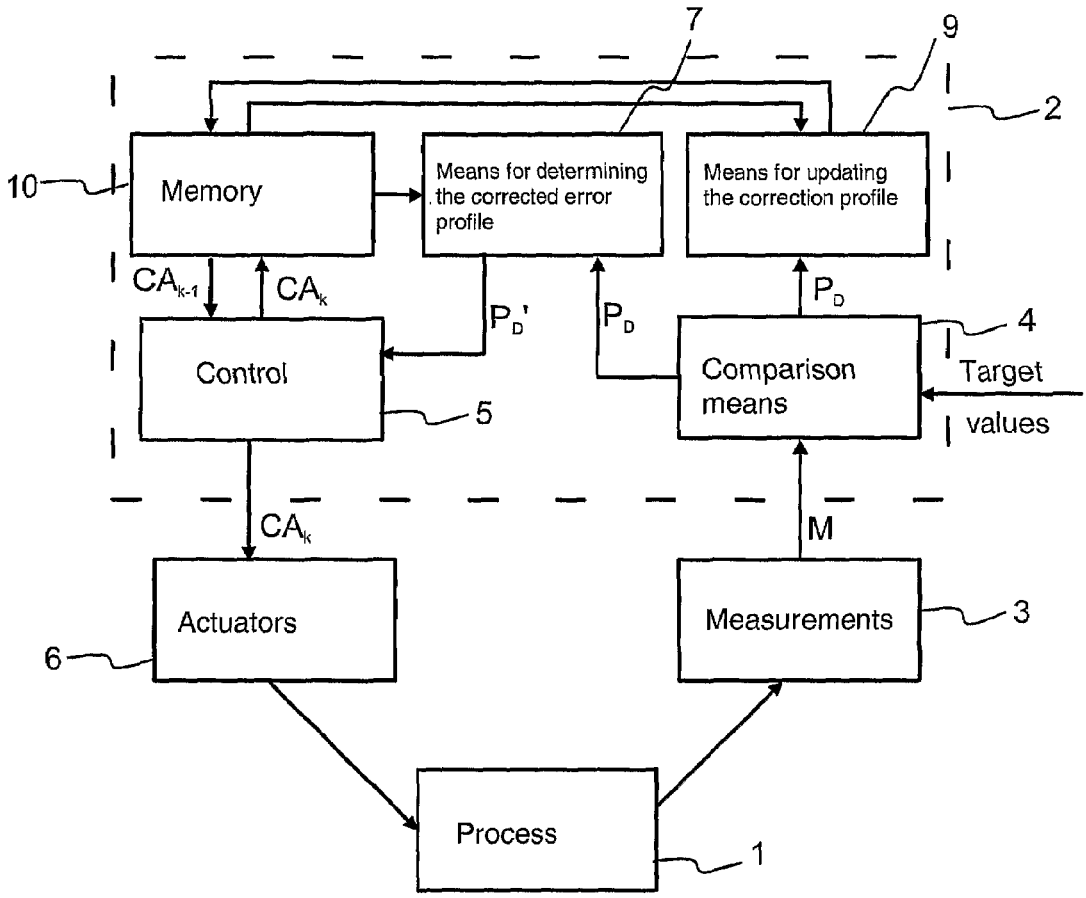
FIG. 3 is a schematic block chart illustrating process control in which corrected error profiles are used.

FIG. 3 shows the control of a manufacturing or finishing process 1 of a fiber web according to the invention. The process 1 is controlled by a control unit 2. The control unit 2 controls the calculation process and it comprises the necessary means for producing the control commands required for controlling the process.

The fiber web moving in the process is measured in its cross direction by means of measuring devices 3 either continuously or in accordance with conditions set for the same. The measuring devices may be composed of one or several measuring sensors, which are moved back and forth in the cross direction of the web, across the width of the web. The measuring devices are selected in accordance with the web property to be measured and they may be for example radiometrical or optical measuring devices. The measuring results are transferred to the control unit 2, which comprises means 4, 5, 7, 9 and 10 for processing the measurement results M and forming control signals C.

The control unit 2 comprises comparison means 4 that compare the measured process values to the target values of the process property that are fed to the comparison means 4. The target values can also be stored in memory means 10 from which they can be retrieved for comparison purposes. On the basis of the comparison the comparison means 4 form an error profile $P_D$ that is transmitted to the means 7 for determining a corrected error profile. If desired, a CD target profile of the process property can also be fed into the comparison means. Thus, either in the measuring devices or control means comprise means for determining a property profile, which form a CD property profile of a measured web property on the basis of the measurement results M, said property profile being fed into the comparison means 4. The comparison means may also be arranged to form a CD property profile of the measured web property on the basis of the measurement results M. It is also possible to feed the target values into the comparison means as a CD target profile of said web property. Thus, the comparison means compare the CD property and target profiles of the web property that have been fed therein and form an error profile $P_D$ on the basis of the comparison.

The control unit 2 comprises means 7 for determining a corrected error profile, which form a corrected error profile $P_D'$ that is transmitted to the control means 5. By using the corrected error profile $P_D'$ and a control signal $CA_{k-1}$ retrieved from the memory means and used in the previous calculation the control means 5 form a new control signal $CA_k$, which is transmitted to one or several actuators 6 affecting said property of the web in the cross direction of the web. The formed new control signals $CA_k$ are stored in the memory means 10. The control unit updates the error profile $P_D$ constantly according to a certain measurement cycle, producing the control signals always on the basis of the latest determined error profile. The error profile $P_D$ can be calculated for example at intervals of two measurements across the width of the web.

As the description above shows, the control unit 2 comprises memory means 10 in which new control signals formed by the control unit 5, and updated or new correction profiles determined by updating means 9 are stored or from which they are retrieved or transmitted. It is also possible to store target values and/or target profiles of a process property in the memory means. The control unit 2 also comprises means 9 for updating the control profile, the function of which will be described hereinbelow.

Figure 4:
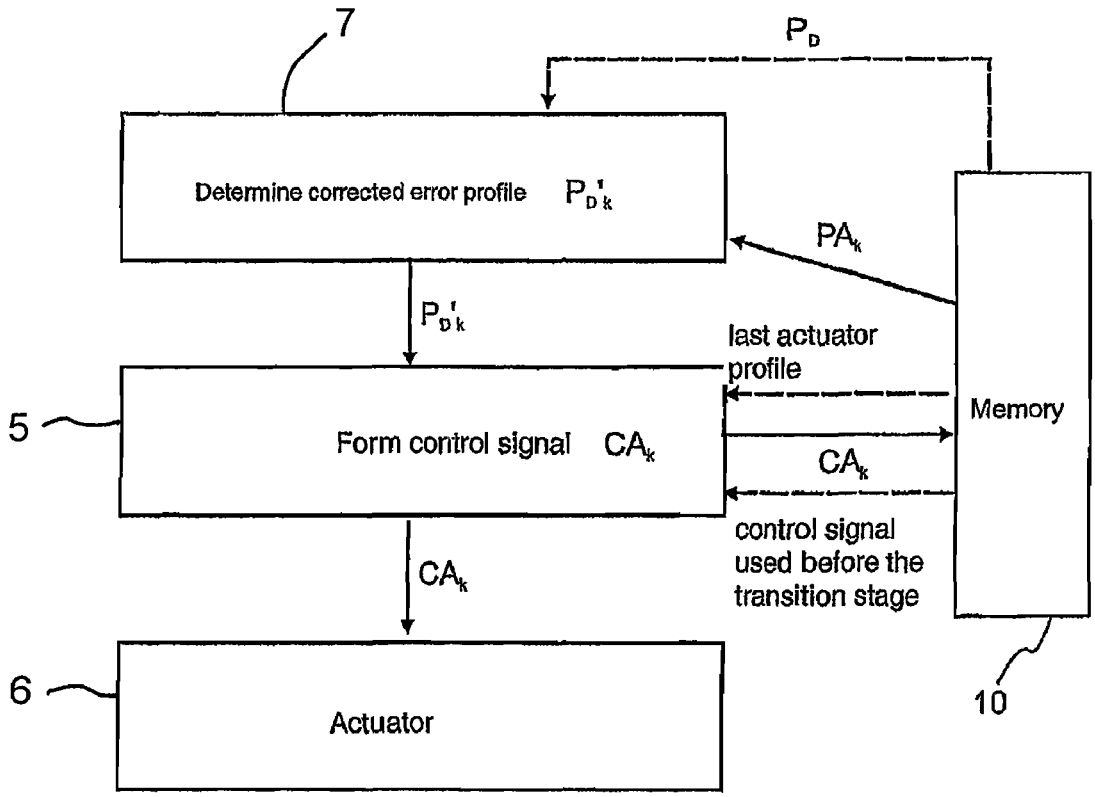
FIG. 4 is a schematic block chart illustrating the act of determining the control signals in the beginning of a transition.
Figure 5:
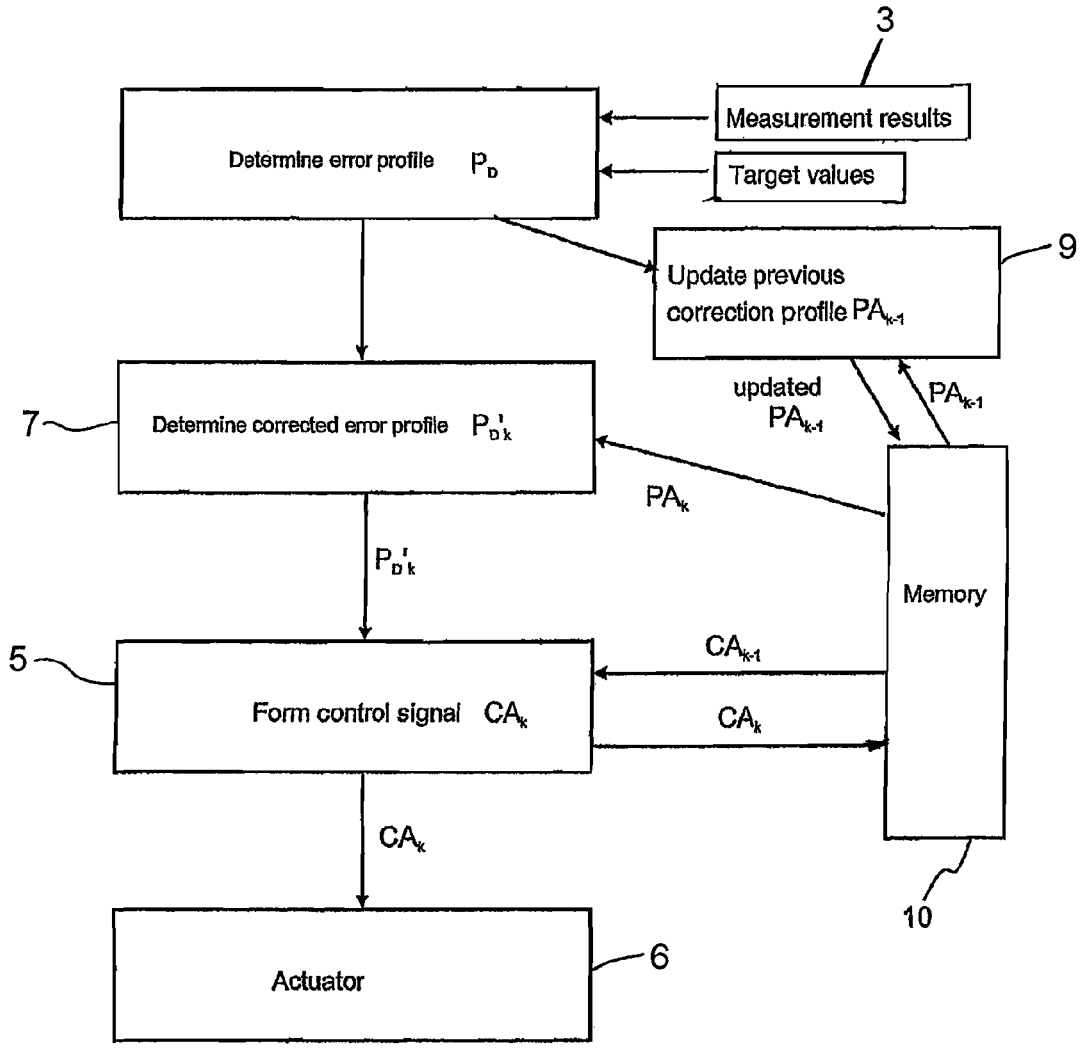
FIG. 5 is a schematic block chart illustrating the act of determining the control signals in the course of the transition.

The method for determining corrected error profiles and new control commands $CA_k$ is illustrated in block charts in FIGS. 4 and 5. The corrected error profiles are determined in accordance with measurements carried out at fixed intervals during the transition stage. The correction profiles to be used during each transition stage have been stored in the memory means 10 so that they form correction profile series. In other words, at the transition stage, marked for example with the letter A, the correction profile series is composed of correction profiles $PA_k$, i.e. $PA_1, PA_2, PA_3, \ldots PA_n$. The subindex k illustrates the number of times the control signal has been determined in each transition stage, i.e. in the first calculation of the transition stage the correction profile $PA_1$ is used and a corrected error profile $P_D'_1$ and a control signal $CA_1$ are determined. The transition stages can be marked with any symbol and there may be any number of them. In the preceding example the letter A functions as an identifier of the series and it does not indicate the time or order in any way.

When the transition stage begins, the series of the stored correction profile series that will be utilized in the calculation is selected. There are several correction profile series stored in the memory for certain operating situations, e.g. for running in the process, and a series suitable for each situation is selected therefrom. The selection criterion may be for example the duration of a break in the process preceding the transition stage. In the following example the correction profile series selected for the calculation is marked with letters $PA_k$ and the corrected error profiles to be determined are marked with letters $P_D'_k$.

When the transition is in the very beginning, i.e. the corrected error profile $P_D'_k$ is determined for the first time, a first corrected error profile $P_D'_k$ and a new control signal $CA_k$ are determined according to the stages shown in FIG. 4. As this is the first calculation of the transition stage, k=1. Thus, the control unit has no measurement results available in the measuring means 3. The first corrected error profile $P_D'_k$ i.e. $P_D'_1$ is determined in the means 7 for determining a corrected error profile by means of a correction profile $PA_1$ obtained from the memory means 10. If desired, it is also possible to use the error profile $P_D$ obtained from the memory means 10 to determine the corrected error profile $P_D'_k$. As an error profile $P_D$ it is possible to use an error profile determined before the transition stage, if it is sufficiently representative, or a so-called zero profile. The correction profile $PA_1$ is a correction profile used in an earlier corresponding transition stage, which has then also been updated and stored in the memory of the control unit as the first correction profile of said correction profile series PA. The correction profile $PA_1$ can also be an experimentally determined correction profile. The first corrected error profile $P_D'_1$ determined in the above-described manner is used for determining the control signal $CA_k$ i.e. $CA_1$ in the control unit 5. If desired, it is also possible to use the last control signal used before the transition stage of the process or an actuator profile obtained from the actuators to determine the control signal $CA_1$. The last control signal and/or actuator profile can be stored in the memory means 10 of the control means 2 before the beginning of the transition stage, or the actuators 6 have been provided with memory means for storing the last control signal and/or actuator profile used before the beginning of the transition stage. The new control signal $CA_1$ is transmitted to the actuators 6 for controlling the process 1.

When the transition stage of the process continues, the process is running and the measurement devices 3 measure the web constantly. The measurement results M are transmitted at certain intervals to the control unit 2. The comparison means 4 determine the error profile $P_D$ again on the basis of the measurement results and the target values. If desired, the target values can also be retrieved from the memory means 10, provided that they have been stored therein.

In the following, the formation of a new control signal $CA_k$ will be described. This is also shown in FIG. 5. As this is the second calculation of the transition stage, k=2. The error profile $P_D$ determined on the basis of the measurement results and target values is transmitted to the means 7 for determining the corrected error profile. To the means 7 for determining the corrected error profile is also transmitted an updated correction profile $PA_2$ determined in the corresponding calculation stage of the correction profile series PA selected beforehand from the memory means 10. The updating of the correction profile $PA_2$ will be described later in this description. By using the correction profile $PA_2$ of the correction profile series PA in the calculation, it is possible to take into account the future development of the change beforehand. The means 7 for determining the corrected error profile form a corrected error profile $P_D'_k$ i.e. $P_D'_2$ on the basis of the error profile $P_D$ and the correction profile $PA_2$. The correction profile $P_D'_2$ thus formed is transmitted to the control means 5. The new control signal $CA_{k-1}$ i.e. $CA_1$ formed in the previous calculation is also transmitted from the memory means 10 to the control means 5. The control means form a new control signal $CA_2$ on the basis of the corrected error profile $P_D'_2$ and the control signal $CA_1$. The new control signal $CA_2$ is transmitted to the actuators 6 and stored in the memory means 10.

As the transition stage proceeds further, the comparison means obtain new measurement results and the calculation of new control signals is repeated so that in the next calculation the means 7 for determining the corrected error profile form a corrected error profile $P_D'_3$ by means of the error profile $P_D$ determined on the basis of the new measurement results, and the correction profile $PA_3$. Thus, the error profile $P_D$ is determined again for each calculation. The control means form a new control signal $CA_3$ on the basis of the corrected error profile $P_D'_3$ and the new control signal $CA_2$ formed in the previous calculation. This continues until the transition stage has ended.

The control signal formed by the control means may be composed of individual control signals to individual actuators or it may be an actuator profile containing control signals for each individual actuator.

The control unit 2 also comprises means 9 for updating the control profile, which update the used correction profiles of the correction profile series in use. The error profile $P_D$ formed by the comparison means 4 in the current calculation is used in the updating. The previous correction profile $PA_{k-1}$ is retrieved from the memory means 10 and it is updated by means of the error profile $P_D$ formed by the comparison means 4. The updated correction profile $PA_{k-1}$ is stored in the memory means 10. Next time said correction profile series is taken in use, all correction profiles have been updated with the error profile $P_D$ of the calculation following their own calculation.

As was stated above, the control unit comprises means for controlling the manufacturing or finishing process of a web. In addition to the above-mentioned means the control unit may also comprise other means. The steps of the above-described control method can be performed by a program, for example a microprocessor. The means may be composed of one or more microprocessors and the application software contained therein. The means may also comprise means for transmission of information and signals between the means. In this example, there are several means carrying out the steps, but the different steps of the method can also be performed in a single means. The means for determining the corrected error profile can be arranged as an independent part of the control unit, as shown in the example of FIG. 3, or they can be integrated as a part of the control means 5. The means for determining the corrected error profile can also be arranged as a separate program unit outside the control unit. Thus, the control unit and the means for determining the corrected error profile have been provided with means for transmitting information between them.

The measurement results measured by the measuring devices can be transmitted to the control unit via conductors or wirelessly. If the measurements are transmitted to the control unit wirelessly, the measuring means are provided with a transmitter for transmitting measurement results, and the control unit is provided with a receiver for receiving measurement results. The control commands produced by the control unit can also be conveyed to the control unit either via conductors or wirelessly. If the control commands are transmitted to the actuators wirelessly, the control unit is provided with a transmitter for transmitting control commands and the actuator is provided with a receiver for receiving control commands.

The means for determining the corrected error profile are in use only during said transition stage. When the process has returned back to its normal operating stage, the correction profiles are no longer used in the calculation. In other words, the error profile is used in the calculation in an unchanged form.

Hereinabove, a situation is described in which the system according to the invention is placed between two different stages in a closed control circuit. If desired, the invention can also be placed in several locations in the control circuit, or it can be completely embedded in the control circuit.

Figure 6:
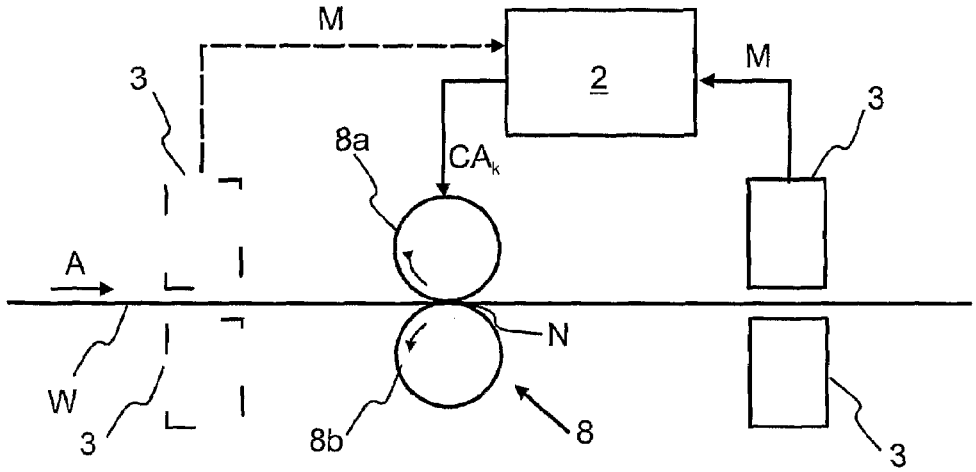
FIG. 6 shows schematically the calendering process and its control.

The invention can be applied for example in the process of starting calendering after a break in the calendering process, or for decelerating the calender before stopping the same. FIG. 6 shows the calendering process of a fiber web in a schematic view. The web W to be calendered is taken to the calender 8 in the direction of the arrow A. One of the rolls forming the calendering nip is a roll 8*a* whose profile can be adjusted, for example a variable crown roll by means of which it is possible to adjust the linear load profile prevailing in the calendering nip N. The calender shown in the figures is a one-nip calender, but the invention can also be applied in multi-nip calenders. In the travel direction of the web, after the calender 8 there are measuring devices 3 measuring at least one property of the web W in its cross direction. The measuring devices 3 may also be placed before the calender, which is shown by means of broken lines in the figure. The measurement results M obtained from the measuring devices are transmitted to the control unit 2 that forms control commands $CA_k$ to the hydraulic actuators of the calender.

Figure 7:
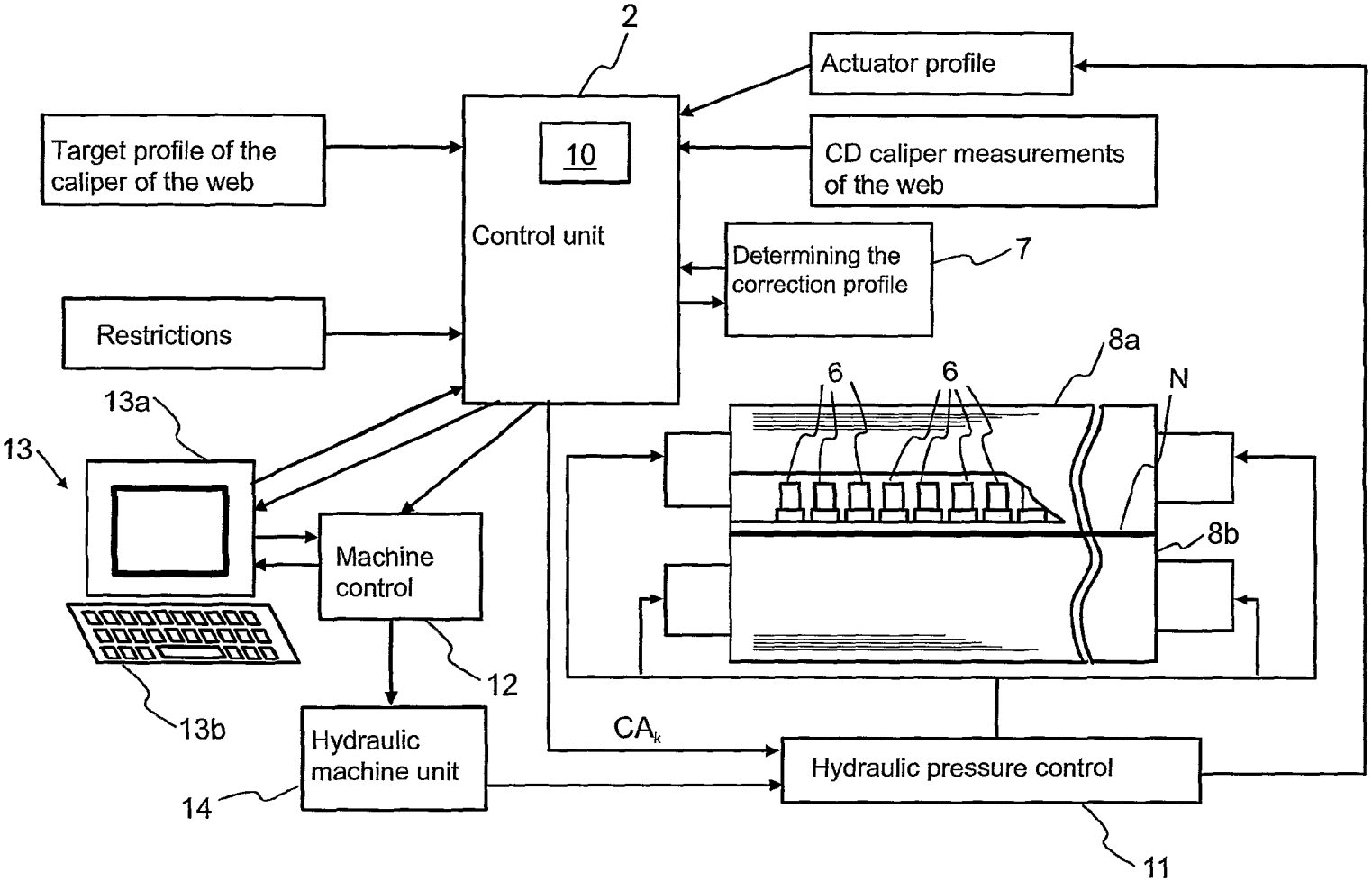
FIG. 7 is a schematic block chart illustrating the control of the calender.

The control of the calender after a break or in connection with decelerating the calender is illustrated in more detail in FIG. 7. The calender 8 comprises two rolls that rotate against each other, one of them being a variable-crown roll 8*a* and the other a heated thermoroll 8*b*. The rolls 8*a* and 8*b* are placed against each other in such a manner that a calendering nip N is formed between them. Inside the variable-crown roll 8*a* there is a row of hydraulic actuators 6 i.e. pistons pressed against the shell of the roll radially in the direction of the axis of the roll. The oil pressure prevailing in the actuators 6 can be adjusted by means of a hydraulic pressure control unit 11, thus attaining the desired linear pressure profile in the calendering nip N.

During the normal run of the calender the linear pressure profile prevailing in the calendering nip N is controlled by means of CD caliper measurements M obtained from the web W. The caliper measurements of the web are transmitted to the control unit 2. The control unit 2 contains all the means disclosed in the description of FIGS. 3 to 5 for forming corrected error profiles and control signals as well as updating corrected profiles. For the sake of clarity, said means have not been shown in FIG. 7. The CD target profile of the caliper of the web and possible limitations of the linear load or profiling are also transmitted to the control unit 2. On the basis of the caliper measurements the control unit forms a caliper profile of the web, compares it to the CD target profile and forms an error profile $P_D$ on the basis of the same. The error profile $P_D$ is constantly updated in accordance with a certain measurement cycle. On the basis of the error profile $P_D$ the control unit forms control commands to the control unit 11 controlling the hydraulic pressures of the actuators, and said unit transmits the control commands further to individual actuators 6.

When a sudden change occurs in the calendering process or it drifts to a transition stage deviating from the normal run, the means for determining a corrected error profile are taken in use. The transition stage deviating from the normal run may be for example the running in of the calender following a web break, or stopping of the calender. Significant reduction of the running speed of the calender in a certain operating stage also constitutes such a transition stage. The essential aspect is that at the transition stage the calender is constantly in operation.

At the transition stage the means 7 for determining the corrected error profile are taken in use. In the beginning of the transition stage, the control unit 2 transmits to the means for determining a corrected error profile a correction profile $PA_1$ and an error profile $P_D$, if desired, which are obtained from the memory means 10 of the control unit 2. On the basis of these the means 7 for determining the corrected error profile form a first corrected error profile $P_D'_1$, which is transmitted back to the control unit 2. By means of the first corrected error profile $P_D'_1$ the control unit 2 forms a new control signal $CA_1$, which is transmitted to the hydraulic pressure control unit 11. The hydraulic pressure control unit 11 controls the hydraulic pressures passed to the actuators 6 of the variable-crown roll 8*a* in accordance with the control signal. The hydraulic machine unit 14 controlled by machine controls 12 produces the necessary pressure and flow of the hydraulic medium. In the process of determining the control signal it is also possible to utilize the actuator profile obtained from the hydraulic pressure control unit 11.

When the transition stage proceeds, the control unit updates the error profile by means of the measurement results. The updated error profile is transmitted to the means 7 for determining the corrected error profile, which determine a corrected error profile $P_D'_k$ on the basis of the error profile $P_D$ and a correction profile $PA_k$ of a correction profile series PA selected beforehand from the memory means 10. The corrected error profile $P_D'_k$ is transmitted to the control unit 2 that forms a new control signal $CA_k$ by means of the corrected error profile $P_D'_k$ and the control signal $CA_{k-1}$ formed in the previous calculation, said control signal $CA_k$ being transmitted further to the hydraulic pressure control unit 11. The updating of the determined correction profiles takes place in the control unit in the way described hereinabove.

As FIG. 7 shows, possible limitations of e.g. the linear load and profiling are also taken into account in the formation of the control signals.

The operator may monitor and control the calendering process by means of a user interface 13. The user interface is connected to the control unit 2 and machine control means 12. The user interface 12 comprises a display 13*a* and one or several input devices 13*b*. The display device may be a display based on a cathode tube, a flat panel display, an image projected onto a substrate, or another device suitable for this use. The input device 13*b* may be a conventional keyboard, a mouse, or another data input device known in the field.

The invention is not intended to be limited to the embodiments presented as examples above, but the invention is intended to be applied widely within the scope of the inventive idea as defined in the appended claims. The method can be used not only for controlling calendering but also for controlling other manufacturing or finishing processes of a fiber web, for example for controlling the following CD profiles: basis weight, moisture, color, tone, formation, fiber orientation, smoothness/roughness, caliper (density and bulk), roll hardness, coating substance, ash, dry matter and additive profiles. The method can also be utilized for correcting CD disturbances occurring in the measurements, as well as for the profile control of a steam box and remoisturizer. Furthermore, the method can be utilized for example for correcting the following disturbances occurring in the MD direction of the web: disturbances occurring in the measurements, disturbances caused by changing the product, and disturbances caused by changes in the running values. The method can also be used in the machine direction (MD) to control the drying efficiency. The method can also be used typically in connection with all feedback controlled control circuits.

The invention claimed is:

1. A method for controlling a manufacturing or finishing process of a fiber web during a transition stage of the manufacturing or finishing process, wherein before the transition stage, a last actuator profile, or a last control signal are stored in a memory, the method comprising the steps of:

when the transition stage begins, selecting a plurality of correction profiles stored in the memory which correspond to an earlier corresponding transition stage;

determining a first corrected error profile by selecting one of said plurality of correction profiles from the memory, or by selecting an error profile obtained from the memory, the error profile selected from memory being an error profile determined before the transition stage, or a zero profile;

obtaining from the memory the last control signal used before the transition stage, or the last actuator profile;

forming a control signal based on the first corrected error profile, and the last control signal, or the last actuator profile;

transmitting the control signal to at least one actuator, and storing the control signal in the memory;

measuring the fiber web in a cross machine direction to obtain measurement results, and transmitting the measurement results at intervals to a control unit;

comparing in the control unit the measurement results to target values to determine an error profile;

correcting the error profile by using a selected corresponding one of said plurality of correction profiles from memory to form a corrected error profile;

obtaining from the memory the control signal in the memory which was previously stored; or the last actuator profile;

forming a control signal based on the corrected error profile and the control signal in the memory which was previously stored, or the last actuator profile;

transmitting the control signal to the at least one actuator, and storing the control signal in the memory;

repeating the steps of measuring the fiber web in the cross machine direction to the step of transmitting the control signal to at least one actuator until the transition stage is complete, whereupon the error profile without correction is used as a basis for forming the control signal.

2. The method of claim 1 wherein the manufacturing or finishing process of the fiber web comprises calendaring the paper web, and the transition stage comprises at least one of the following transition stages: starting up, stopping or deceleration of the calender.

3. The method of claim 1 wherein the plurality of correction profiles are recorded by storing in memory the corrected error profiles as they are determined.

4. The method of claim 1 wherein the correction profiles which are used to form the corrected error profiles which are further used to form the control signal are used such that the control signal takes into account a future development of the transition stage so performing a correction compensating for the effect of the transition stage beforehand in forming the control signals.

5. The method of claim 1 wherein the at least one property of the web is measured continuously in a cross direction of the web.

6. The method of claim 1 wherein the at least one actuator comprises a plurality of actuators.

7. The method of claim 6 wherein the control signal is composed of individual control signals to individual actuators or is an actuator profile containing control signals for each individual actuator.

8. A method for controlling a manufacturing or finishing process of a fiber web of the type wherein at least one actuator controls at least one property of the fiber web, and wherein said at least one property of the web is measured downstream of the at least one actuator by at least one sensor to determine measured properties, the output of the at least one sensor is transmitted to a control unit in which measured properties are compared to selected target values, and an error profile is created which indicates the difference between the measured properties and the selected target values, the error profile is used to control the actuator(s) to conform the at least one property of the fiber web to the target values, the improvement comprising:

during transition stages of the manufacturing or finishing process, recording the error profiles during the progression of the transition stages, to form a plurality of correction profiles stored in memory, each correction profile comprising a multiplicity of recorded transition stage error profiles;

controlling the manufacturing or finishing process of the fiber web during a particular transition stage by selecting one of said recorded correction profiles which corresponds in type to the particular transition stage; and during the duration of the particular transition stage when said at least one property of the web is measured downstream of the actuator(s) with the sensor(s), and the output of the sensor(s) are transmitted to the control unit where the measured properties are compared to selected target values, and an error profile is created, correcting the error profile by using at least one recorded transition stage error profile to form a corrected error profile, and using said corrected error profile to form a control signal which is used to control the actuator(s) to conform at least one property of the fiber web to the target values.

9. The method of claim 8 wherein the manufacturing or finishing process of the fiber web comprises calendaring the paper web, and the particular transition stage comprises at least one of the following transition stages: starting up, stopping or deceleration of the calender.

10. The method of claim 8 wherein the step of recording the error profiles during the progression of the transition stages includes recording the corrected error profiles as they are determined.

11. The method of claim 8 wherein the correction profiles which are used to form the corrected error profiles which are further used to form the control signal are used such that the control signal takes into account a future development of the transition stage so performing a correction compensating for the effect of the transition stage beforehand in forming the control signals.

12. The method of claim 8 wherein the at least one property of the web is measured continuously in a cross direction of the web.

13. The method of claim 8 wherein the least one actuator comprises a plurality of actuators.

14. The method of claim 13 wherein the control signal is composed of individual control signals to individual actuators or is an actuator profile containing control signals for each individual actuator.

15. A method for controlling a manufacturing or finishing process of a fiber web of the type wherein at least one actuator (s) controls at least one property of the fiber web, and wherein said at least one property of the web is measured downstream of the at least one actuator(s) by at least one sensor to determine measured properties, the output of the at least one sensor is transmitted to a control unit in which measured properties are compared to selected target values, and an error profile is created which indicates the difference between the measured properties and the selected target values, the error profile is used to control the actuator(s) to conform the at least one property of the fiber web to the target values, the improvement comprising:

determining experimentally a correction profile comprising a multiplicity of transition stage error profiles;

controlling the manufacturing or finishing process of the fiber web during a particular transition stage by utilizing said experimentally determined correction profile which corresponds in type to the particular transition stage; and during the duration of the particular transition stage when said at least one property of the web is measured downstream of the actuator(s) with the sensor(s), and the output of the sensor(s) are transmitted to the control unit where the measured properties are compared to selected target values, and an error profile is created, correcting the error profile by using at least one experimentally determined transition stage error profile to form a corrected error profile, and using said corrected error profile to form a control signal which is used to control the actuator(s) to conform at least one property of the fiber web to the target values.

16. The method of claim 15 wherein the manufacturing or finishing process of the fiber web comprises calendaring the paper web, and the particular transition stage comprises at least one of the following transition stages: starting up, stopping or deceleration of the calender.

17. The method of claim 15 wherein corrected error profiles which are further used to form the control signal are used such that the control signal takes into account a future development of the transition stage so performing a correction compensating for the effect of the transition stage beforehand in forming the control signals.

18. The method of claim 15 wherein the at least one property of the web is measured continuously in a cross direction of the web.

19. The method of claim 15 wherein the at least one actuator comprises a plurality of actuators.

* * * * *